US007415968B1

(12) United States Patent
Matas et al.

(10) Patent No.: US 7,415,968 B1
(45) Date of Patent: Aug. 26, 2008

(54) MODULAR FUEL DELIVERY ASSEMBLY FOR AN AIRCRAFT ENGINE

(75) Inventors: Scott E. Matas, Williamsport, PA (US); Steven J. Bowes, Williamsport, PA (US)

(73) Assignee: Lycoming Engines, a division of Avco Corporation, Williamsport, PA (US)

( * ) Notice: Subject to any disclaimer, the term of this patent is extended or adjusted under 35 U.S.C. 154(b) by 0 days.

(21) Appl. No.: 11/809,589

(22) Filed: Jun. 1, 2007

Related U.S. Application Data

(60) Provisional application No. 60/926,038, filed on Apr. 24, 2007.

(51) Int. Cl.
*F02M 55/02* (2006.01)
*F02M 69/46* (2006.01)

(52) U.S. Cl. ..... 123/456; 123/468; 123/469

(58) Field of Classification Search ..... 123/456, 123/468, 469
See application file for complete search history.

(56) References Cited

U.S. PATENT DOCUMENTS 4,286,563 A * 9/1981 Fahim et al. ..... 123/469
4,286,777 A * 9/1981 Brown ..... 267/294
4,306,708 A * 12/1981 Gassaway et al. ..... 267/141.3
5,044,338 A 9/1991 Shelton
5,682,857 A 11/1997 Briggs et al.
6,178,950 B1 * 1/2001 Stockner et al. ..... 123/470
6,213,096 B1 * 4/2001 Kato et al. ..... 123/456
6,340,019 B1 1/2002 Eshleman et al.
6,408,827 B1 * 6/2002 Scollard et al. ..... 123/470
6,513,499 B2 * 2/2003 Kehoe ..... 123/456
6,604,512 B2 * 8/2003 Kato ..... 123/509
6,912,996 B2 * 7/2005 Kato ..... 123/469
7,004,146 B1 * 2/2006 Kato ..... 123/467
7,263,975 B2 * 9/2007 Stieler et al. ..... 123/456
2007/0163545 A1 * 7/2007 Beardmore et al. ..... 123/456

* cited by examiner

*Primary Examiner*—Thomas N Moulis
(74) *Attorney, Agent, or Firm*—BainwoodHuang

(57) ABSTRACT

An engine includes a fuel rail and fuel delivery devices, such as fuel injectors, that deliver fuel to corresponding cylinder assemblies. The use of the fuel rail and fuel injectors allows unused fuel to be purged from the engine at the end of the engine's operating cycle, thereby minimizing the creation of fuel vapor within the engine. The fuel rail is assembled from modular fluid conduit adaptors and fluid conduits. With such modularity, a custom fuel rail can be assembled for any size engine. The use of the fluid conduit adaptors and fluid conduits allows motion of the cylinder assemblies relative to the fuel rail during operation to minimize the application of potentially damaging forces on the fuel rail.

23 Claims, 10 Drawing Sheets

MODULAR FUEL DELIVERY ASSEMBLY FOR AN AIRCRAFT ENGINE

CROSS REFERENCE TO RELATED APPLICATIONS

This patent application claims the benefit of U.S. Provisional Patent Application No. 60/926,038 filed on Apr. 24, 2007, entitled, "FULLY CONSTRAINED FUEL INJECTOR MOUNT FOR COMPLIANT FUEL DELIVERY SYSTEM", the contents and teachings of which are hereby incorporated by reference in their entirety.

BACKGROUND

Conventional reciprocating aircraft engines include multiple cylinder head assemblies used to drive a crankshaft. During operation, in order to drive the crankshaft each cylinder head assembly requires fuel, such as provided by a fuel pump. For example, as illustrated in FIGS. 1A and 1B, a conventional aircraft engine 10 includes separate cylinder assemblies, collectively referred to as 12, and a fuel distribution assembly 14 that provides fuel to each cylinder assembly 12 from the fuel pump (not shown). As illustrated, the fuel distribution assembly 14 includes a hub 16, connector tubes 18, and fuel nozzles 20 where each connector tube 18 and fuel nozzle 20 connects the hub 16 to a corresponding cylinder assembly 12. In use, the hub 16 receives fuel from the fuel pump and distributes the fuel to each cylinder assembly 12 through each corresponding connector tube 18 and fuel nozzle 20.

During operation, as a piston (not shown) reciprocates within each cylinder assembly 12, the piston generates a force within the cylinder assembly 12 sufficient to cause relative motion of the cylinder assembly 12. For example, as a piston within a cylinder assembly 12-1 fires, the loads generated by the piston on the crankshaft causes the cylinder assembly 12-1 to generate a load on the crankcase 22 which carries the cylinder assemblies 12. This load causes the crankcase 22 to bend or flex such that the operational cylinder assembly 12-1 moves relative to the then non-operational cylinder assemblies 12-2, 12-3. To prevent damage to the fuel distribution assembly 14 as caused by the relative motion of the cylinder assemblies, the connector tubes 18 of the fuel delivery assembly are formed of a generally flexible material. As a result, during operation of the aircraft engine 10, as each cylinder assembly 12-1, 12-2, 12-3 moves relative to each other, the connector tubes 18 absorb the motion of the cylinder assemblies 12-1, 12-2, 12-3 relative to the hub 16. Accordingly, the flexibility of the connector tubes 18 helps to prevent the development and propagation of fractures within the fuel delivery system during operation.

SUMMARY

Conventional fuel delivery systems for aircraft engines can suffer from certain deficiencies. For example, while the fuel distribution assembly 14 provides fuel to each cylinder assembly 12 from the fuel pump during operation, the fuel distribution assembly 14 cannot purge the fuel contained within the connector tubes 18 at the conclusion of operation of the engine 10. Accordingly, once the engine 10 is turned off, a portion of the fuel contained within the connector tubes 18 drains into the cylinder assemblies 12 through corresponding nozzles 20. In this post-operational state, the cylinder assemblies 12 absorb heat from the engine components which, in turn, vaporizes the fuel contained in the cylinder assemblies 12 and connector tubes 18. Vaporization of the fuel within the fuel distribution assembly 14 can disrupt the operation of the fuel pump during a subsequent operation of the engine. Additionally, in aircraft engines, the cylinder assemblies move independently of each other during operation. This requires a certain amount of compliance in the fuel distribution assembly to minimize damage during operation.

Embodiments of the present invention provide a fuel delivery system that allows fuel to be purged from an engine following engine operation and that allows for relative motion of the cylinder assemblies during operation while minimizing the application of excessive loads on the fuel delivery system. The engine includes a fuel rail and fuel delivery devices, such as fuel injectors, that deliver fuel to corresponding cylinder assemblies. The use of the fuel rail and fuel injectors allows unused fuel to be purged from the engine at the end of the engine's operating cycle, thereby minimizing the creation of fuel vapor within the engine. The fuel rail is assembled from modular fluid conduit adaptors and fluid conduits. With such modularity, a custom fuel rail can be assembled for any size engine. The use of the fluid conduit adaptors and fluid conduits allows motion of the cylinder assemblies relative to the fuel rail during operation to minimize the application of potentially damaging forces on the fuel rail.

In one arrangement, a fuel delivery assembly for an aircraft engine includes a set of fluid conduit adaptors and a set of fluid conduits. Each fluid conduit adaptor of the set of fluid conduit adaptors is constructed and arranged to be secured to a corresponding cylinder assembly of the aircraft engine. Each fluid conduit adaptor of the set of fluid conduit adaptors defines a first lumen constructed and arranged to carry fuel between a fuel inlet and a fuel outlet of the fuel delivery assembly and a second lumen in fluid communication with the first lumen, the second lumen constructed and arranged to provide fuel from the first lumen to the corresponding cylinder assembly. Each fluid conduit of the set of fluid conduits has a first end disposed in fluid communication with the first lumen of a first fluid conduit adaptor of the set of fluid conduit adaptors and an opposing second end disposed in fluid communication with the first lumen of a second fluid conduit adaptor of the set of fluid conduit adaptors. Each fluid conduit of the set of fluid conduits is constructed and arranged to carry fuel between the fuel inlet and the fuel outlet of the fuel delivery assembly. At least one of at least one fluid conduit adaptor of the set of fluid conduit adaptors and at least one fluid conduit of the set of fluid conduits is constructed and arranged to absorb at least a portion of a load generated by motion of a cylinder assembly of the aircraft engine relative to the fuel delivery assembly.

In one arrangement, an aircraft engine includes a crankcase assembly having a crankcase housing and a crankshaft disposed within the crankcase housing. The aircraft engine includes a set of cylinder assemblies coupled to the crankcase housing of the crankcase assembly, each cylinder assembly of the set of cylinder assemblies having a cylinder housing, a piston, and a connecting rod. The piston and connecting rod are disposed within the cylinder housing with the piston coupled to the connecting rod and the connecting rod coupled to the crankshaft. The engine includes a fuel delivery assembly having a set of fluid conduit adaptors and a set of fluid conduits. Each fluid conduit adaptor of the set of fluid conduit adaptors is secured to a corresponding cylinder assembly of the aircraft engine. Each fluid conduit adaptor of the set of fluid conduit adaptors defines a first lumen constructed and arranged to carry fuel between a fuel inlet and a fuel outlet of the fuel delivery assembly and a second lumen in fluid communication with the first lumen, the second lumen constructed and arranged to provide fuel from the first lumen to the corresponding cylinder assembly. Each fluid conduit of the set of fluid conduits has a first end disposed in fluid communication with the first lumen of a first fluid conduit adaptor of the set of fluid conduit adaptors and an opposing second end disposed in fluid communication with the first lumen of a second fluid conduit adaptor of the set of fluid conduit adaptors. Each fluid conduit of the set of fluid conduits is constructed and arranged to carry fuel between the fuel inlet and the fuel outlet of the fuel delivery assembly. At least one of (i) at least one fluid conduit adaptor of the set of fluid conduit adaptors and (ii) at least one fluid conduit of the set of fluid conduits is constructed and arranged to absorb at least a portion of a load generated by motion of a cylinder assembly of the aircraft engine relative to the fuel delivery assembly.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Figure 1A:
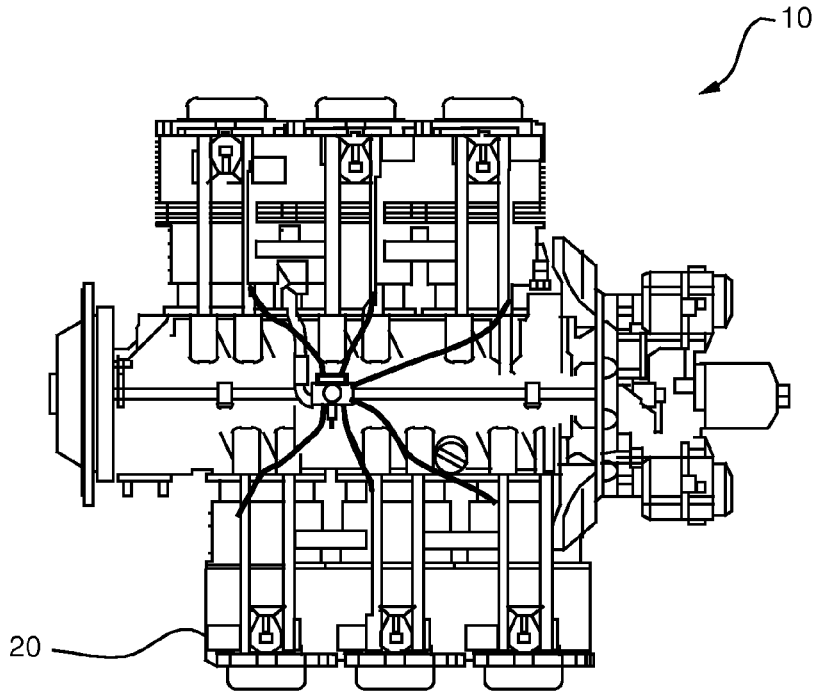
FIG. 1A (PRIOR ART)
FIG. 1A illustrates a top view of a prior art engine.
Figure 1B:
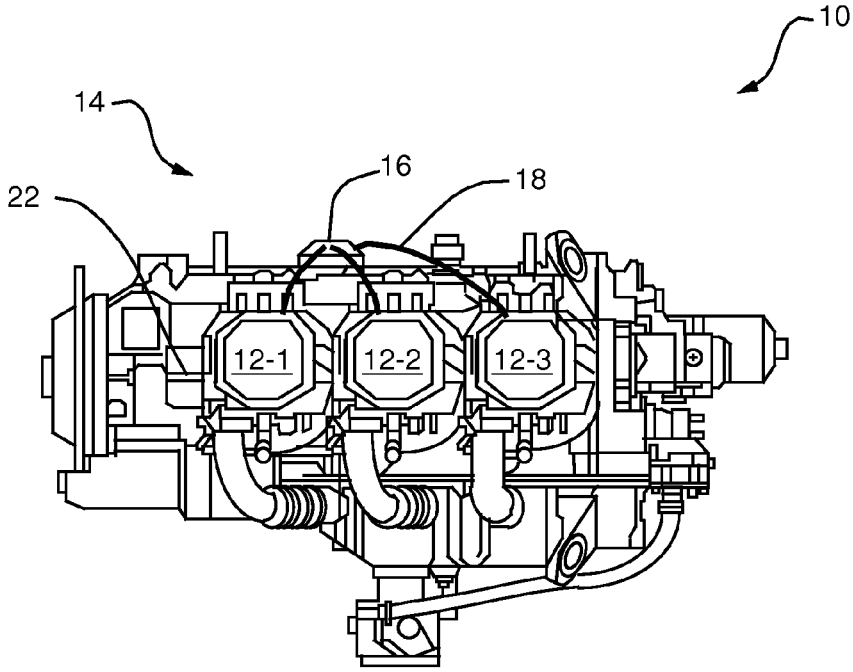
FIG. 1B (PRIOR ART)
FIG. 1B illustrates a side view of the prior art engine of FIG. 1A.

Embodiments of the present invention provide a fuel delivery system that allows fuel to be purged from an engine following engine operation and that allows for relative motion of the cylinder assemblies during operation while minimizing the application of excessive loads on the fuel delivery system. The engine includes a fuel rail and fuel delivery devices, such as fuel injectors, that deliver fuel to corresponding cylinder assemblies. The use of the fuel rail and fuel injectors allows unused fuel to be purged from the engine at the end of the engine's operating cycle, thereby minimizing the creation of fuel vapor within the engine. The fuel rail is assembled from modular fluid conduit adaptors and fluid conduits. With such modularity, a custom fuel rail can be assembled for any size engine. The use of the fluid conduit adaptors and fluid conduits allows motion of the cylinder assemblies relative to the fuel rail during operation to minimize the application of potentially damaging forces on the fuel rail.

FIGS. 2 and 3A through 3D illustrate an arrangement of an engine 50, such as an aircraft engine, having a crankcase assembly 52, a set of cylinder assemblies collectively provided as 54, and a fuel delivery system 56. The crankcase assembly 52 includes a crankcase housing 58 and a crankshaft (not shown) disposed within the crankcase housing 58. Each cylinder assembly 60 of the set of cylinder assemblies 54 includes a cylinder housing 62 secured to the crankcase housing 58 of the engine 50. For example, each cylinder assembly 60 couples to the crankcase housing 58 by fasteners that are inserted through a series of openings defined by the cylinder assembly 60 and secured to the crankcase housing 58.

Figure 2:
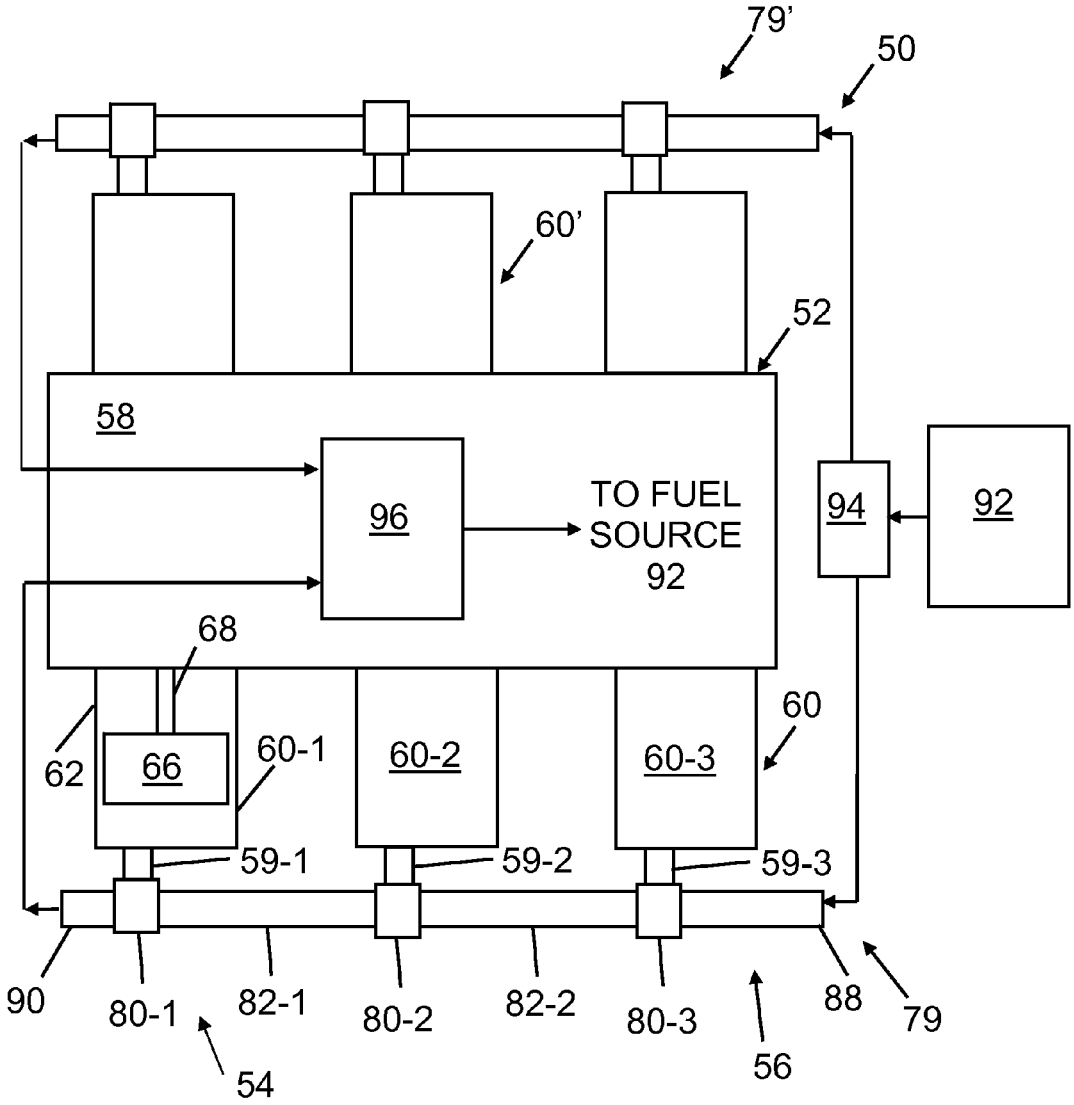
FIG. 2 illustrates a schematic overhead view of an engine having a fuel delivery assembly, according to one embodiment of the invention.

Each cylinder assembly 60, as indicated in a cut-away view of a cylinder assembly in FIG. 2, includes a piston 66 and a connecting rod 68 disposed within the cylinder housing 62. The connecting rod 68 connects to both the piston 66 and the crankshaft (not shown) carried by the crankcase assembly 52. The piston 66 and connecting rod 68 are configured to reciprocate within the cylinder housing 62 to drive or rotate the crankshaft. While the engine 50 can have any number of cylinder assemblies, in one arrangement, as indicated in FIG. 2, the engine 50 includes six cylinder assemblies 60, with three cylinder assemblies 60 being mounted to either side of the crankcase housing 58.

The fuel delivery system 56 is configured to provide fuel from a fuel source 92 to each of the cylinder assemblies 60. As indicated in FIG. 2, the fuel delivery system 56 includes two separate fuel delivery assemblies or fuel rails 79, 79', a first fuel rail 79 configured to carry fuel to cylinder assemblies 60 disposed on a first side of the crankcase housing 58 and a second fuel rail 79' configured to carry fuel to cylinder assemblies 60' disposed on a second, opposing side of the crankcase housing 58. For convenience, the following description will focus on a single fuel rail associated with the engine 50.

The fuel rail 79 is disposed between a fuel inlet 88 and a fuel outlet 90. In one arrangement, as particularly illustrated in FIG. 2, the fuel inlet 88 is fluid communication with the fuel source or tank 92 by way of a fuel pump 94. The fuel pump 94 is configured to withdraw fuel from the fuel source 92 and deliver the fuel under pressure to the fuel inlet 88 of the fuel rail 79. Also in the arrangement shown, the fuel outlet 90 is in fluid communication with the fuel source 92 by way of a fuel pressure regulator 96. The fuel pressure regulator 96 is configured to receive, from the fuel outlet 90, unused fuel carried by the fuel rail 79 and deliver the unused fuel to the fuel source 92. The combination of the fuel rail 79 with the fuel pump 94, fuel pressure regulator 96 and the fuel source 92 forms a fluid circuit.

Figure 3A:
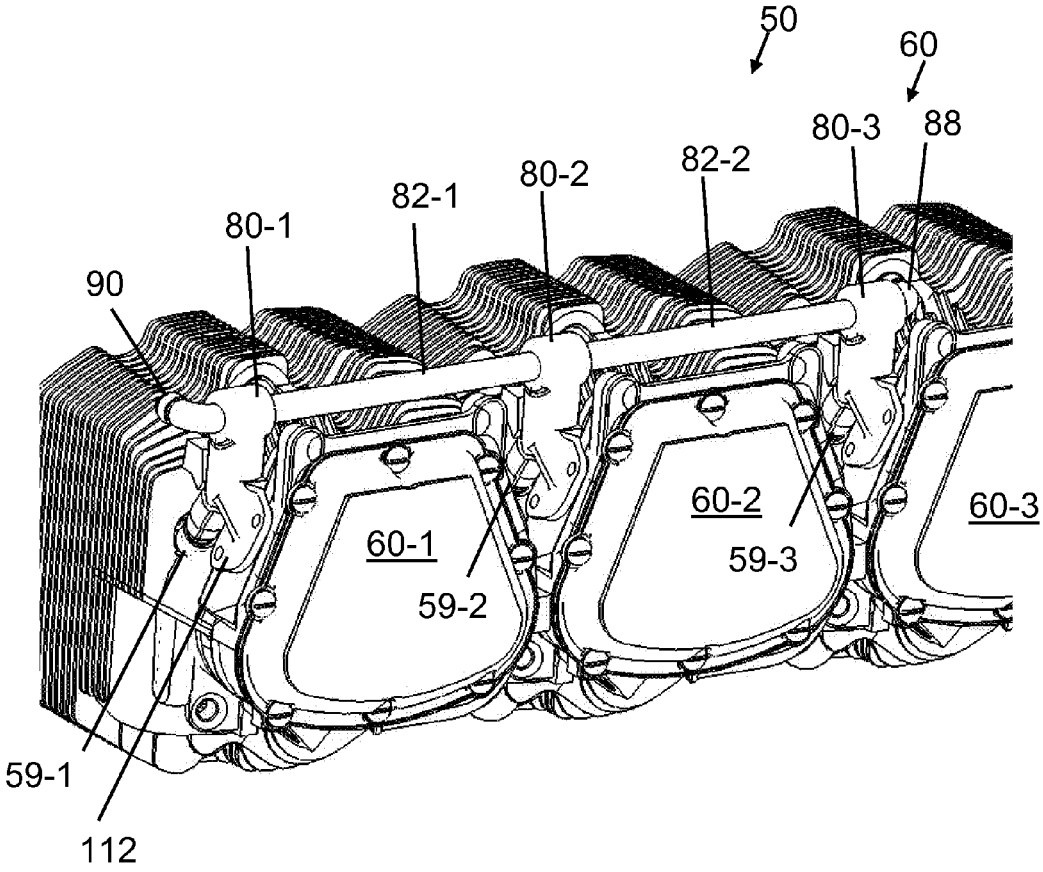
FIG. 3A illustrates a perspective view of the engine having a fuel delivery assembly of FIG. 2.
Figure 3B:
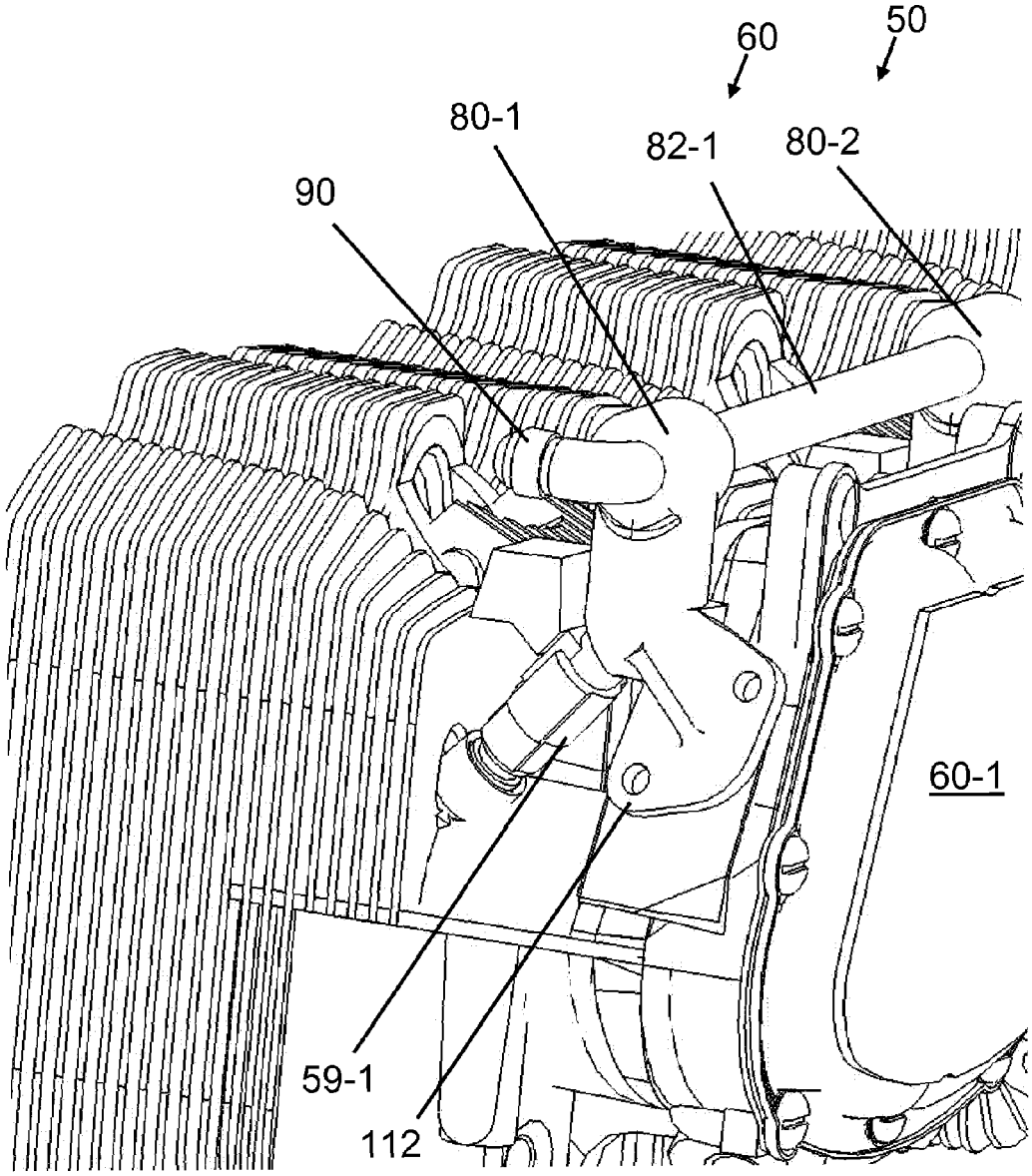
FIG. 3B illustrates a perspective view of a cylinder assembly of the fuel delivery assembly of FIG. 2.
Figure 3C:
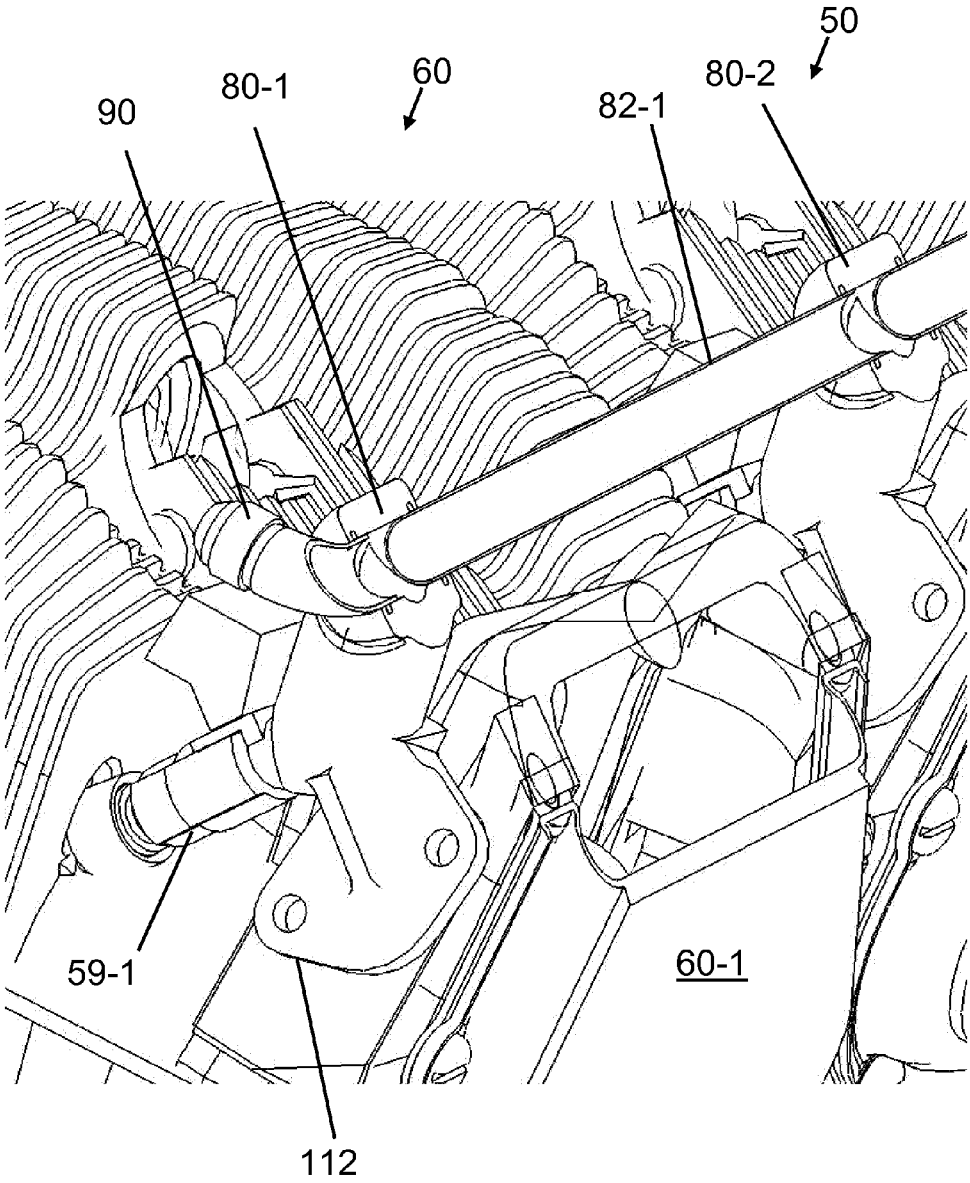
FIG. 3C illustrates another perspective view of the cylinder assembly of the fuel delivery assembly of FIG. 2.
Figure 3D:
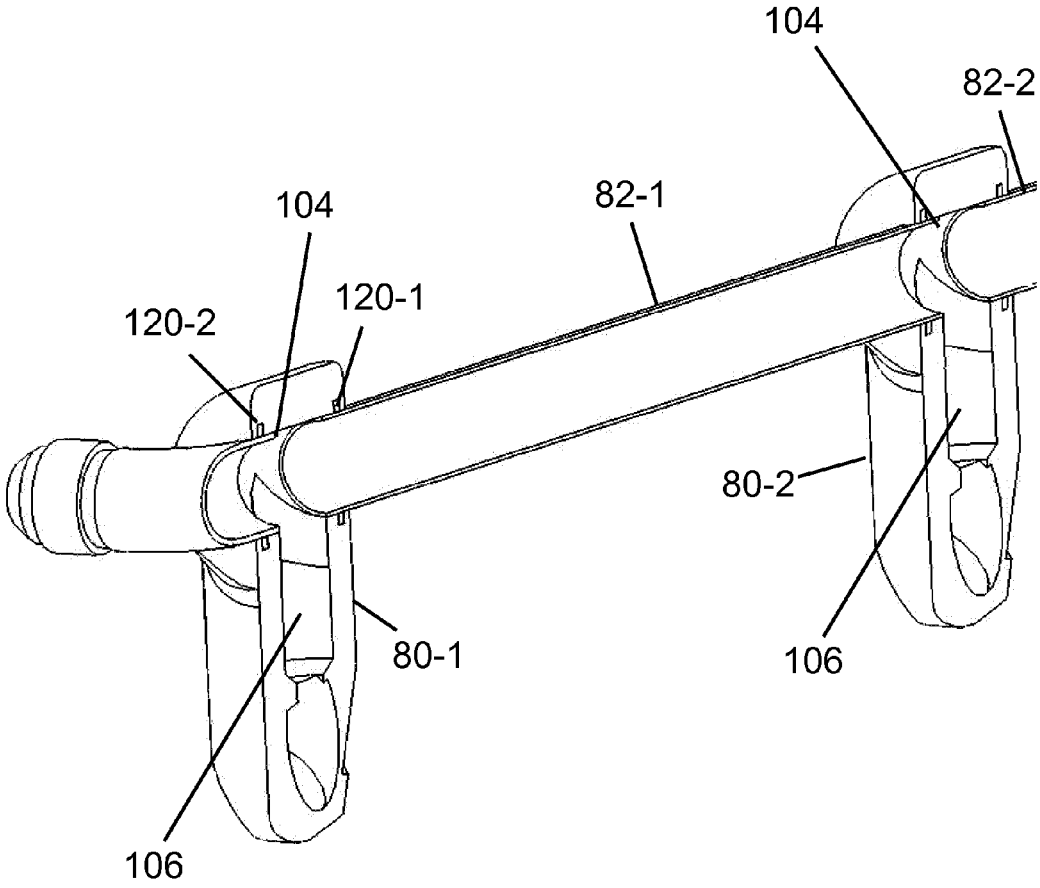
FIG. 3D illustrates a sectional view of a portion of the fuel delivery assembly of FIG. 2.
Figure 3E:
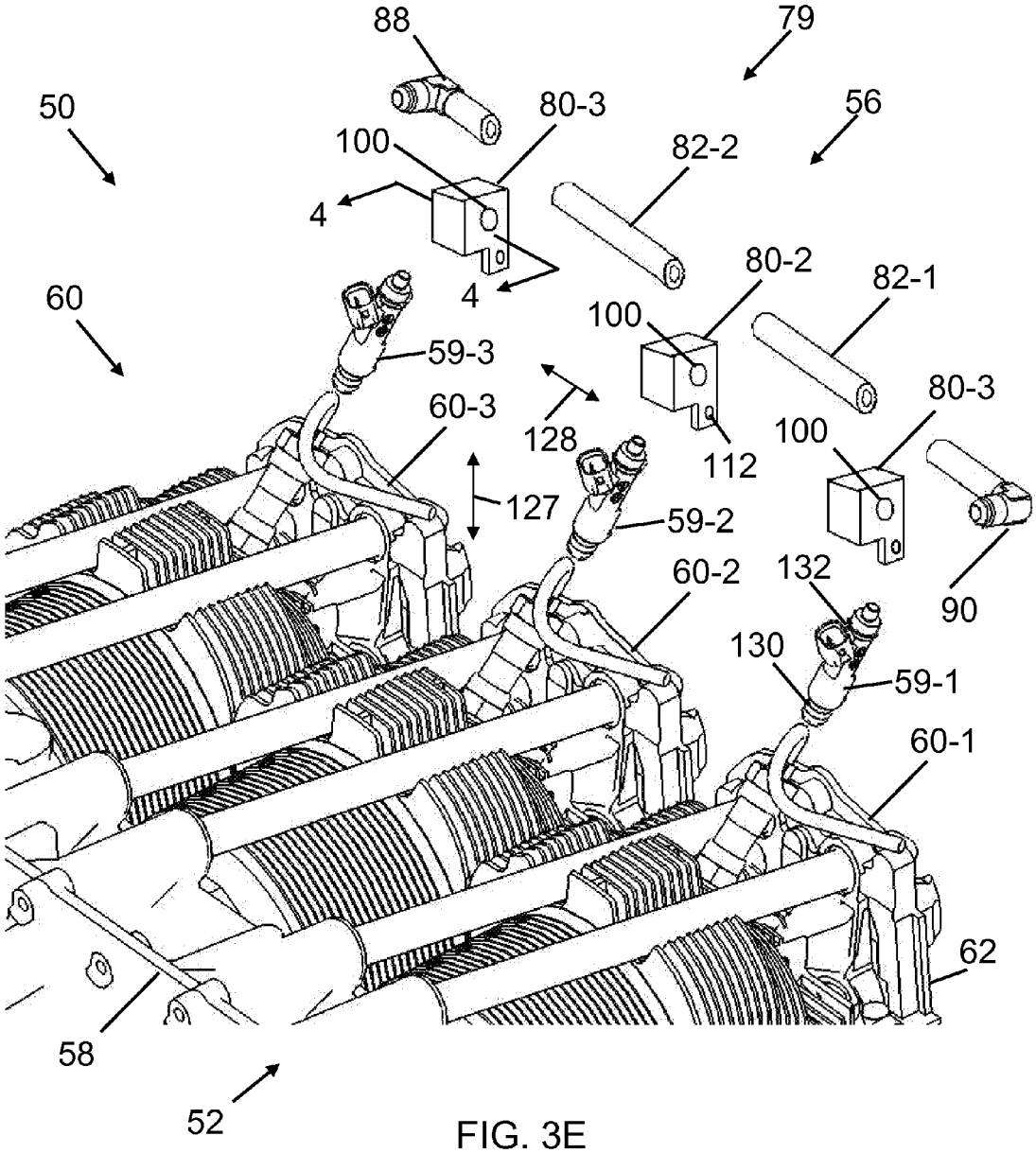
FIG. 3E illustrates a perspective exploded view of the engine and fuel delivery assembly of FIG. 2.

In one arrangement, with particular reference to FIGS. 2 and 3A, the fuel rail 79 is disposed along a length of the engine 50 as defined by serially-located cylinder assemblies 60. For example, as illustrated, the fuel rail 79 extends along the head portions of first, second, and third cylinder assemblies 60- through 60-3. The fuel rail 79 is positioned relative to the engine 50 in this manner to minimize interference with the engine's operation (e.g., operation of the cylinder assemblies or cooling of the engine 50).

As illustrated in FIGS. 2 and 3A through 3D, the fuel rail 79 is formed from a series of modular components. In the arrangement illustrated, the fuel rail 79 includes a set of fluid conduit adaptors 80 and a set of fluid conduits 82. The fuel rail 79 also includes fuel delivery devices 59 configured to provide fuel carried by the fuel rail 79 to corresponding cylinder assemblies 60.

Each fluid conduit 82-1, 82-1 is formed as a generally tubular structure from a substantially rigid material, such as steel. While any number of fluid conduits 82 can be used as part of the fuel rail, in the arrangement illustrated, the fuel rail 79 includes a first fluid conduit 82-1 and a second fluid conduit 82-2. The fluid conduits 82 couple to the fluid conduit adaptors 80 to provide fluid communication between the fluid inlet 88 and the fluid outlet 90. For example, the first fluid conduit 82-1 is coupled to and provides fluid communication between a first fluid conduit adaptor 80-1 and a second fluid conduit adaptor 80-2 while the second fluid conduit 82-2 is coupled to and provides fluid communication between the second fluid conduit adaptor 80-2 and a third fluid conduit adaptor 80-3.

In one arrangement, the number of fluid conduit adaptors 80 within the fuel rail 79 corresponds to the number of cylinder assemblies 60 disposed on either the first or second side of the crankcase housing 58. For example, with reference to FIGS. 2 and 3, the engine 50 includes, on one side of the crankcase housing 58, three cylinder assemblies 60-1 through 60-3. Accordingly, as illustrated in FIGS. 2 and 3, the set of fluid conduit adaptors 80 includes three fluid conduit adaptors 80-1, 80-2, and 80-3. In such an arrangement, each fluid conduit adaptor 80 is operable to provide fuel to a corresponding cylinder assembly 60 of the engine 50, as will be described in detail below.

Figure 4:
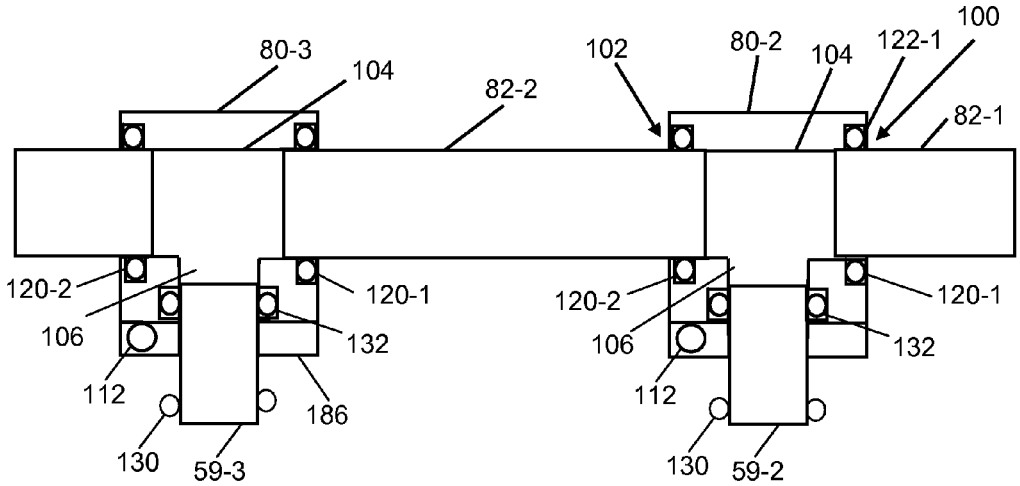
FIG. 4 illustrates a sectional view of a portion of the fuel delivery assembly of FIG. 2.

Each fluid conduit adaptor 80 is configured to be coupled to the fluid conduits 82 to form the fuel rail 79. For example, with reference to FIG. 4, each fluid conduit adaptor 80 includes a first port 100 and a second port 102. Opposing fluid conduits 82 couple to the ports 100, 102, such as by a friction fit, to define at least part of a fuel pathway in the fuel rail 79. For example, a first fluid conduit 82-1 is coupled to a first port 100 of a fluid conduit adaptor 80-2 and a second fluid conduit 82-2 is coupled to a second port 102 of the fluid conduit adaptor 80-2. Each fluid conduit adaptor 80 is configured to allow flow of fuel through the fuel rail 79, such as from the fuel inlet 88 to the fuel outlet 90. For example, as indicated in FIG. 4, each of the fluid conduit adaptors 80 defines a first lumen 104 constructed and arranged to carry fuel between a fuel inlet 88 and a fuel outlet 90 of the fuel rail 80 via the fluid conduits 82.

Each fluid conduit adaptor 80 is configured to divert a portion of the fuel flowing through the fuel rail 79 into a corresponding cylinder assembly 60. For example, each fluid conduit adaptors 80 also defines and a second lumen 106 in fluid communication with the first lumen 104 where the second lumen 106 diverts a portion of the fuel flowing through the first lumen 104 to a corresponding cylinder assembly 60.

While each fluid conduit adaptor 80 can be constructed and arranged to provide fuel to a corresponding cylinder assembly 60, in one arrangement, the fluid conduit adaptor 80 includes a fuel delivery device 59 that delivers fuel to the cylinder assembly 60. In one arrangement, at least a portion of a fuel delivery device 59, such as a fuel injector, is disposed within the second lumen 106. With reference to FIG. 3, during operation, as a volume of fuel flows through the fuel rail 79, the first fluid conduit adaptor 80-1 diverts a portion of the fuel to the first fuel delivery device 59-1 which, in turn, provides the portion of the fuel to the first cylinder assembly 60-1. Also during operation, the second fluid conduit adaptor 80-2 diverts a portion of the fuel to the second fuel delivery device 59-1 provides a portion of the fuel volume to the second cylinder assembly 60-2, and the third fluid conduit adaptor 80-3 diverts a portion of the fuel to the fuel delivery device 59-3 that in turn provides a portion of the fuel volume to the third cylinder assembly 60-3. While each fuel delivery device 59 can be configured in a variety of ways, in one arrangement, the fuel delivery device 59 is configured as a fuel injector that atomizes the received fuel and provides the atomized fuel to the corresponding cylinder assembly 60.

In one arrangement, as indicated in FIGS. 3A through 3E, the fluid conduit adaptors 80 are constructed and arranged to secure the fuel rail 79 to corresponding cylinder assemblies 60 of the aircraft engine 50. For example, each fluid conduit adaptor 80 defines an aperture 112 that is sized and shaped to receive a protrusion (not shown), such as a post, extending from a corresponding cylinder assembly 60. Interaction between the protrusion and the fluid conduit adaptor aperture 112 secures the fluid conduits 82 and the fuel rail 79 to the engine 50.

The fluid conduit adaptors 80 are also constructed and arranged to allow for relative motion of the cylinder assemblies 60 during operation while minimizing the application of excessive loads on portions of the fuel rail 79. In one arrangement, each fluid conduit adaptor 80 includes a compliant member 120 disposed between the fluid conduit adaptor 80 and a corresponding fluid conduit 82. For example, with reference to FIG. 4, the fluid conduit adaptor 80-2 includes a first compliant member 120-1, configured as an o-ring, disposed at the first port 100 within a first channel 122-1. The fluid conduit adaptor 80-2 also includes a second compliant member 120-2, configured as an o-ring, disposed at the first port 102 within a second channel 122-2. The compliant members 120 are configured to yield elastically upon application of a force thereto to absorb at least a portion of a load generated by the cylinder assemblies 60 on the fuel rail 80 during operation. For example, while the compliant member 120 can be formed from a variety of materials, in one arrangement, the compliant member 120 is formed of a rubber material that compresses in response to application of a compressive loading. Accordingly, the compressive properties of the compliant member 120 allow for dissipation of at least a portion of the load generated by the cylinder assemblies 60 on the fuel rail 80 during operation.

In use, and with particular attention to FIGS. 2-4, each cylinder assembly 60 receives fuel from a corresponding fuel delivery device 59. The fuel explodes within each cylinder assembly housing 62 and causes the piston 66 and a connecting rod 68 to reciprocate within the cylinder assembly housing 62. Forces generated by cylinder assemblies 60 on the crankshaft (not shown) disposed within the crankcase housing 58 causes the crankcase housing 58 to flex or bend, such as at the location of cylinder assemblies 60. Accordingly, such flexure causes each cylinder assembly 60 and attached fluid conduit adaptor 80-2 to move relative to the fuel conduits 82 of the fuel rail 79.

With particular reference to cylinder assembly 60-2, as the cylinder assembly 60-1 moves along a substantially vertical direction 127, along a substantially horizontal direction 128, or along some combination of the two directions 127, 128, the cylinder assembly 60-2 moves the fluid conduit adaptor 80-2 relative to the fluid conduits 82-1, 82-2. Accordingly, because the compliant members 120-1, 120-2 are disposed between the fluid conduit adaptor 80-2 and the fluid conduits 82-1, 82-2, the compliant members 120-1, 120-2 become compressed in response to such motion. This compression helps to absorb a least a portion of the load generated by the cylinder assembly 60-2 on the fuel rail 79 (e.g., the load generated on the fuel conduits 82-1, 82-2), thereby minimizing excessive loading on and potential damage to the fuel rail 79.

At the conclusion of the engine's operation, because the engine 50 is configured with the fuel rail 79 as described above, a user can drain fuel from the engine to minimize vaporization of the fuel within the engine 50. For example, with respect to FIG. 2, while the engine 50 is hot after operation, the fuel pressure regulator 96 receives unused fuel from the cylinder assemblies 60 and from the fuel rail 79 via fuel outlet 90 and delivers the unused fuel to the fuel source 92. Accordingly, because the fuel rail 79 allows fuel to be purged from the engine 50 after engine operation, the fuel rail 79 minimizes the ability for portions of the engine 50 to become disrupted by fuel vaporization.

While various embodiments of the invention have been particularly shown and described, it will be understood by those skilled in the art that various changes in form and details may be made therein without departing from the spirit and scope of the invention as defined by the appended claims.

For example, as indicated above, the fluid conduit adaptors 80 are constructed and arranged to secure the fuel rail 79 to corresponding cylinder assemblies 60 of the aircraft engine 50. In one arrangement, each of the fluid conduit adaptors 80 are moveably coupled a corresponding cylinder assembly 60. In one arrangement, with particular reference to FIGS. 3 and 4, each fluid conduit adaptor defines an aperture 112 having a diameter that is larger than an outer diameter of the protrusion. In this configuration, when the protrusion extends into the aperture 112, the fluid conduit adaptor 80 secures the fuel rail 79 to a cylinder assembly 60 while allowing both vertical 127 and longitudinal 128 motion of the fuel rail 79 relative to each cylinder assembly 60. Such motion can be caused, for example, when operation of the cylinder assemblies 60 causes the fuel rail 79 to move within the engine 50.

For example, assume that during operation, the second cylinder assembly 60-2 fires and generates a horizontal and vertical load on the fuel rail 79. The compliant members 112-1 and 112-2 of the fluid conduit adaptor 80-2 absorb at least some of the vertical and longitudinal forces generated by the cylinder assembly 60-2 on the fuel rail 79. However, generally longitudinal motion of the cylinder assembly 60-2 can cause the fuel rail 79 to translate along the longitudinal direction 128 relative to adjacent cylinder assemblies 60-1, 60-3. Because the diameter of the apertures 112 for each fluid conduit adaptor 80-1, 80-3 is larger than an outer diameter of the protrusion for each adjacent cylinder assembly 60-1, 60-3, substantially longitudinal translation of the fuel rail 79 causes the fluid conduit adaptor 80-1, 80-3 to translate relative to the protrusions of each cylinder assembly 60-1, 60-3. Accordingly, the configuration of the fluid conduit adaptors 80 minimizes loading of the fuel rail 79 at any of the locations of the fluid conduit adaptors 80 as caused by longitudinal translation of the fuel rail 79 within the engine 50.

As indicated above, the fluid conduit adaptors 80 include compliant members 120, disposed in proximity to corresponding fluid conduits 82, that are configured to absorb at least a portion of the lateral and vertical loads applied to the fuel rail 79 by a corresponding cylinder assembly 60. In one arrangement, the fuel delivery devices 59 also operate to absorb these lateral and vertical loads. For example, with particular attention to FIGS. 3E and 4, each fuel delivery device 59, such as a fuel injector, includes compliant members 130, 132 disposed at opposing ends. As illustrated, the fuel injectors include a first compliant member 130, such as an O-ring, disposed at a cylinder assembly coupling end of the fuel injector 59 and a second compliant member 132, such as an O-ring, disposed at a fuel rail coupling end of the fuel injector 59. The first and second compliant members 130, 132 absorb at least a portion of a load generated by the cylinder assembly 60-1 on the fuel rail 80 during operation. The first and second compliant members 130, 132 also act to seal a fluid pathway between the fuel rail 80 and the corresponding cylinder assembly 60. For example, the cylinder assembly coupling end of the fuel injector 54 is disposed within a corresponding port of the cylinder assembly 60 such that interaction between the cylinder assembly port and the cylinder assembly coupling end of the fuel injector 54 compresses the first compliant member 130 to seal the fuel injector 54 relative to the cylinder assembly 60. Also, the fuel rail coupling end of the fuel injector 54 is disposed within a corresponding fuel delivery port 186 of the fluid conduit adaptor 80 such that interaction between the fuel delivery port 186 and the fuel rail coupling end of the fuel injector 54 compresses the second compliant member 132 to seal the fuel injector 54 relative to the fluid conduit adaptor 80.

Figure 5:
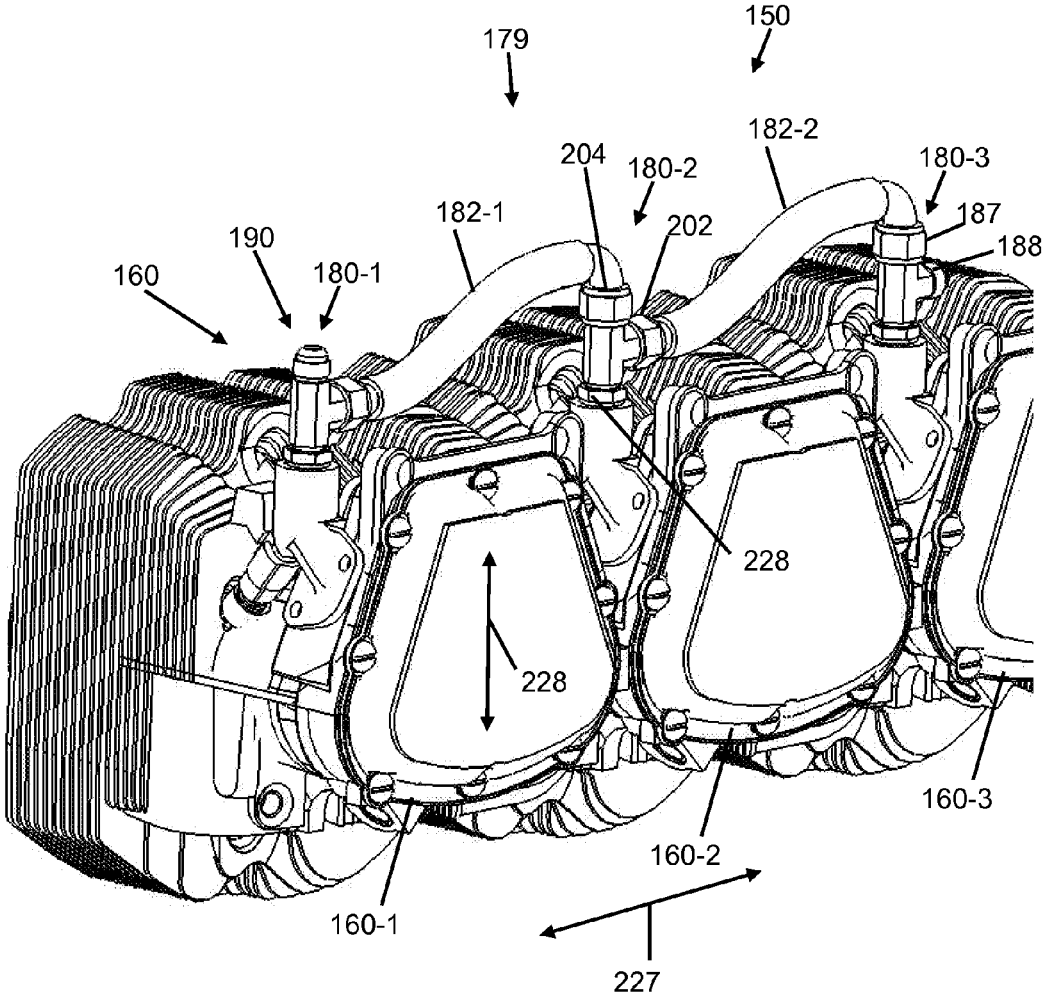
FIG. 5 illustrates a perspective of an aircraft engine having a fuel delivery assembly, according to one embodiment of the invention
Figure 6:
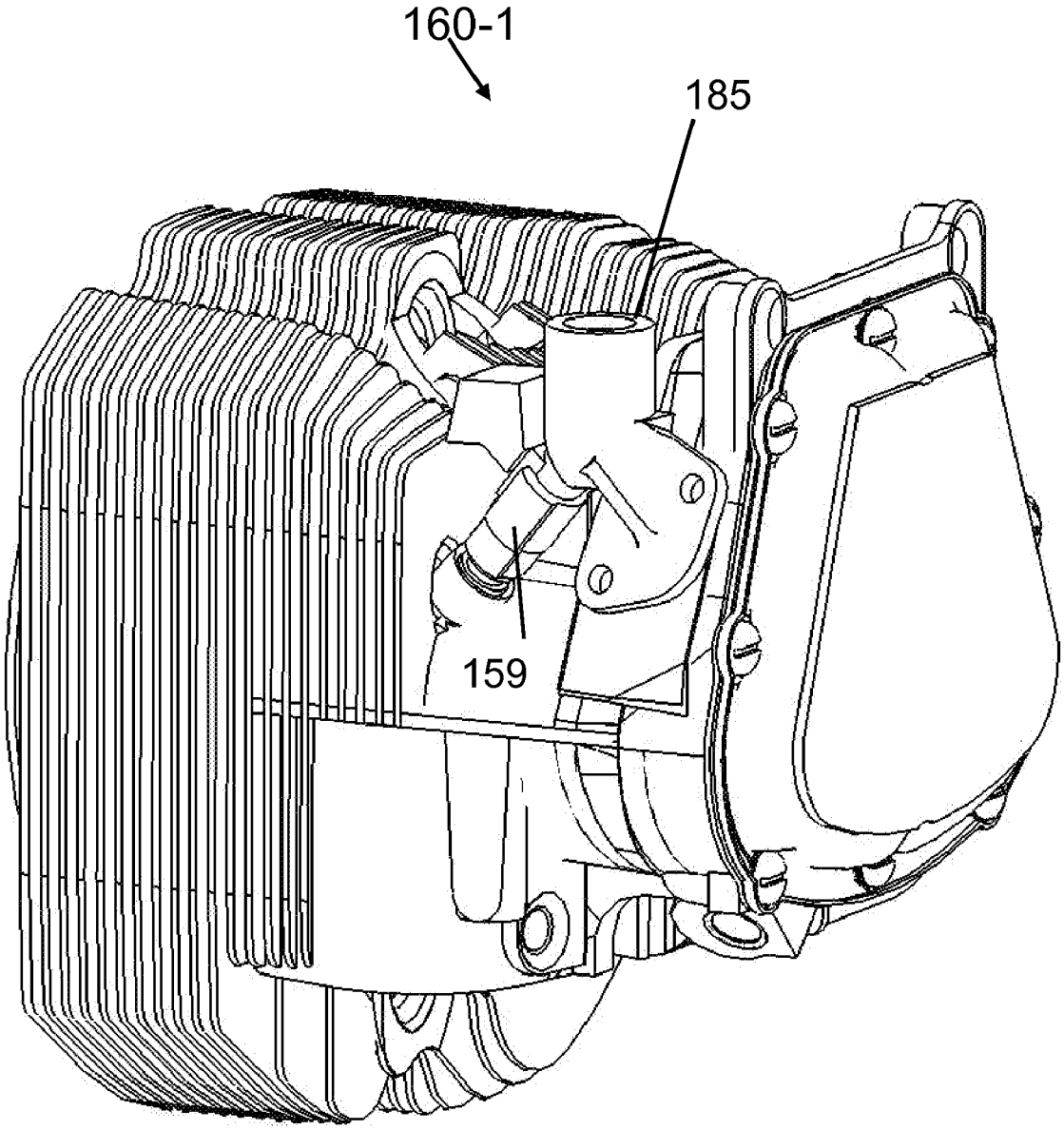
FIG. 6 illustrates a portion of a fluid conduit adaptor of the fuel delivery assembly of FIG. 5.

As described above, the fuel conduits 82 are formed of a substantially rigid material while the fluid conduit adaptors 80 include compliant members 120 disposed between the fluid conduit adaptor 80 and the fuel conduits 82. The compliant members 120 are configured to absorb at least a portion of a load generated by the cylinder assemblies 60 on the fuel rail 80 during operation. Such description is by way of example only. In one arrangement, as illustrated in FIGS. 5 and 6, an engine 150 includes cylinder assemblies 160 having a fuel rail 179 formed of substantially rigid fluid conduit adaptors 180 and compliant fuel conduits 82.

Each fluid conduit adaptor 180 includes a first adaptor portion 185 and a second adaptor portion 187. The first adaptor portion 185 secures the fluid conduit adaptor 180 to a corresponding cylinder assembly, such as cylinder assembly 160-1 shown in FIG. 6. The first adaptor portion 185 also provides fluid communication, via a lumen, between the second adaptor portion 187 and a fuel delivery device 159, such as a fuel injector. The second adaptor portion 187 is configures to carry fuel from a fuel inlet 188 to a fuel outlet 190 while diverting a portion of the fuel to the second adaptor portion 187. For example, the second adaptor portion 187 is configured as a generally T-shaped adaptor having a first port 200 in fluid communication with the first adaptor portion 185 and having second and third ports 202, 204 that provide fluid communication between adjoining fuel conduits 182.

The fuel conduits 182 are constructed and arranged to allow for relative motion of the cylinder assemblies 160 during operation while minimizing the application of excessive loads on portions of the fuel rail 179. In one arrangement, each fluid conduit 182 is formed from a compliant material such as a rubber material. The compliant fluid conduits 182 are configured to absorb at least a portion of a load generated by the cylinder assemblies 60 on the fuel rail 80 during operation. For example, in use operation of the cylinder assemblies 160 causes an associated crankcase housing (not shown) to flex or bend, such as at the location of cylinder assemblies 60. Accordingly, such flexure causes each cylinder assembly 60 and attached fluid conduit adaptor 180 to move relative to the fuel conduits 182 of the fuel rail 79.

With particular reference to cylinder assembly 160-2, as the cylinder assembly 160-1 moves along a substantially vertical direction 227, along a substantially horizontal direction 228, or along some combination of the two directions 227, 228, the cylinder assembly 160-2 moves the fluid conduit adaptor 180-2 relative to the fluid conduits 182-1, 182-2. Accordingly, because the fluid conduits 182-1, 182-2 are formed of a compliant material, the fluid conduits 182-1, 182-2 become expanded or contracted in response to such motion. This expansion or contraction helps to absorb a least a portion of the load generated by the cylinder assembly

160-2 on the fuel rail 179 (e.g., the load generated on the fuel conduits 182-1, 182-2), thereby minimizing excessive loading on and potential damage to the fuel rail 179.

What is claimed is:

1. A fuel delivery assembly for an aircraft engine, comprising:

a set of fluid conduit adaptors, each fluid conduit adaptor of the set of fluid conduit adaptors constructed and arranged to be secured to a corresponding cylinder assembly of the aircraft engine, each fluid conduit adaptor of the set of fluid conduit adaptors defining a first lumen constructed and arranged to carry fuel between a fuel inlet and a fuel outlet of the fuel delivery assembly and a second lumen in fluid communication with the first lumen, the second lumen constructed and arranged to provide fuel from the first lumen to the corresponding cylinder assembly; and a set of fluid conduits, each fluid conduit of the set of fluid conduits having a first end disposed in fluid communication with the first lumen of a first fluid conduit adaptor of the set of fluid conduit adaptors and an opposing second end disposed in fluid communication with the first lumen of a second fluid conduit adaptor of the set of fluid conduit adaptors, each fluid conduit of the set of fluid conduits being constructed and arranged to carry fuel between the fuel inlet and the fuel outlet of the fuel delivery assembly;

wherein at least one of (i) at least one fluid conduit adaptor of the set of fluid conduit adaptors and (ii) at least one fluid conduit of the set of fluid conduits is constructed and arranged to absorb at least a portion of a load generated by motion of a cylinder assembly of the aircraft engine relative to the fuel delivery assembly.

2. The fuel delivery assembly of claim 1, wherein each fluid conduit adaptor of the set of fluid conduit adaptors comprises a first port disposed at a first end of the first lumen and a second port disposed at a second end of the first lumen, at least one of the first port and the second port of at least one fluid conduit adaptor comprising a compliant member constructed and arranged to absorb at least a portion of the load generated by motion of the cylinder assembly of the aircraft engine relative to the fuel delivery assembly.

3. The fuel delivery assembly of claim 2, wherein at least one fluid conduit adaptor of the set of fluid conduit adaptors comprises a fuel delivery device disposed between the second lumen defined by the at least one fluid conduit adaptor and the corresponding cylinder assembly.

4. The fuel delivery assembly of claim 3, wherein the fuel delivery device comprises a first compliant member disposed at a cylinder assembly coupling end of the fuel delivery device and a second compliant member disposed at a fluid conduit adaptor coupling end of the fuel delivery device, the first compliant member and the second compliant member constructed and arranged to absorb at least a portion of the load generated motion of the corresponding cylinder assembly relative to the fuel delivery assembly.

5. The fuel delivery assembly of claim 3, wherein the fuel delivery device comprises a fuel injector.

6. The fuel delivery assembly of claim 2, wherein at least one fluid conduit adaptor of the set of fluid conduit adaptors is moveably coupled to the corresponding cylinder assembly.

7. The fuel delivery assembly of claim 1, wherein at least one fluid conduit of the set of fluid conduits is formed from a compliant material constructed and arranged to absorb at least a portion of the load generated by motion of the cylinder assembly of the aircraft engine relative to the fuel delivery assembly.

8. The fuel delivery assembly of claim 7, wherein at least one fluid conduit adaptor of the set of fluid conduit adaptors comprises a fuel delivery device disposed between the second lumen defined by the at least one fluid conduit adaptor and the corresponding cylinder assembly.

9. The fuel delivery assembly of claim 8, wherein the fuel delivery device comprises a first compliant member disposed at a cylinder assembly coupling end of the fuel delivery device and a second compliant member disposed at a fluid conduit adaptor coupling end of the fuel delivery device, the first compliant member and the second compliant member constructed and arranged to absorb at least a portion of the load generated motion of the corresponding cylinder assembly relative to the fuel delivery assembly.

10. The fuel delivery assembly of claim 8, wherein the fuel delivery device comprises a fuel injector.

11. The fuel delivery assembly of claim 9, wherein at least one fluid conduit adaptor of the set of fluid conduit adaptors is moveably coupled to the corresponding cylinder assembly.

12. The fuel delivery assembly of claim 1, comprising a fuel pressure regulator in fluid communication with the fuel outlet of the fuel delivery assembly, the fuel pressure regulator being constructed and arranged to withdraw fuel from the fuel outlet and to deliver the withdrawn fuel to a fuel tank.

13. The fuel delivery assembly of claim 1, comprising a fuel pump in fluid communication with the fuel inlet of the fuel rail, the fuel pump being constructed and arranged to withdraw fuel from a fuel tank and to deliver the withdrawn fuel to the fuel inlet of the fuel rail.

14. The fuel delivery assembly of claim 1, wherein:

at least one of the first port and the second port of each fluid conduit adaptor comprises a compliant member constructed and arranged to absorb at least a portion of the load generated by motion of the cylinder assembly of the aircraft engine relative to the fuel delivery assembly; and at least one fluid conduit adaptor of the set of fluid conduit adaptors comprises a fuel delivery device secured each fluid conduit adaptor and disposed between the second lumen defined by each fluid conduit adaptor and the corresponding cylinder assembly.

15. An aircraft engine, comprising:

a crankcase assembly having a crankcase housing and a crankshaft disposed within the crankcase housing;

a set of cylinder assemblies coupled to the crankcase housing of the crankcase assembly, each cylinder assembly of the set of cylinder assemblies having a cylinder housing, a piston, and a connecting rod, the piston and connecting rod being disposed within the cylinder housing, the piston coupled to the connecting rod and the connecting rod coupled to the crankshaft; and a fuel delivery assembly having:

a set of fluid conduit adaptors, each fluid conduit adaptor of the set of fluid conduit adaptors secured to a corresponding cylinder assembly of the aircraft engine, each fluid conduit adaptor of the set of fluid conduit adaptors defining a first lumen constructed and arranged to carry fuel between a fuel inlet and a fuel outlet of the fuel delivery assembly and a second lumen in fluid communication with the first lumen, the second lumen constructed and arranged to provide fuel from the first lumen to the corresponding cylinder assembly; and a set of fluid conduits, each fluid conduit of the set of fluid conduits having a first end disposed in fluid communication with the first lumen of a first fluid conduit adaptor of the set of fluid conduit adaptors and an opposing second end disposed in fluid communication with the first lumen of a second fluid conduit adaptor of the set of fluid conduit adaptors, each fluid conduit of the set of fluid conduits being constructed and arranged to carry fuel between the fuel inlet and the fuel outlet of the fuel delivery assembly;

wherein at least one of (i) at least one fluid conduit adaptor of the set of fluid conduit adaptors and (ii) at least one fluid conduit of the set of fluid conduits is constructed and arranged to absorb at least a portion of a load generated by motion of a cylinder assembly of the aircraft engine relative to the fuel delivery assembly.

16. The aircraft engine of claim 15, wherein each fluid conduit adaptor of the set of fluid conduit adaptors comprises a first port disposed at a first end of the first lumen and a second port disposed at a second end of the first lumen, at least one of the first port and the second port of at least one fluid conduit adaptor comprising a compliant member constructed and arranged to absorb at least a portion of the load generated by motion of the cylinder assembly of the aircraft engine relative to the fuel delivery assembly.

17. The aircraft engine of claim 16, wherein at least one fluid conduit adaptor of the set of fluid conduit adaptors comprises a fuel delivery device disposed between the second lumen defined by the at least one fluid conduit adaptor and the corresponding cylinder assembly.

18. The aircraft engine of claim 17, wherein the fuel delivery device comprises a first compliant member disposed at a cylinder assembly coupling end of the fuel delivery device and a second compliant member disposed at a fluid conduit adaptor coupling end of the fuel delivery device, the first compliant member and the second compliant member constructed and arranged to absorb at least a portion of the load generated motion of the corresponding cylinder assembly relative to the fuel delivery assembly.

19. The aircraft engine of claim 17, wherein the fuel delivery device comprises a fuel injector.

20. The aircraft engine of claim 16, wherein at least one fluid conduit adaptor of the set of fluid conduit adaptors is moveably coupled to the corresponding cylinder assembly.

21. The aircraft engine of claim 15, wherein at least one fluid conduit of the set of fluid conduits is formed from a compliant material constructed and arranged to absorb at least a portion of the load generated by motion of the cylinder assembly of the aircraft engine relative to the fuel delivery assembly.

22. The aircraft engine of claim 15, comprising a fuel pressure regulator in fluid communication with the fuel outlet of the fuel delivery assembly, the fuel pressure regulator being constructed and arranged to withdraw fuel from the fuel outlet and to deliver the withdrawn fuel to a fuel tank.

23. The aircraft engine of claim 15, comprising a fuel pump in fluid communication with the fuel inlet of the fuel rail, the fuel pump being constructed and arranged to withdraw fuel from a fuel tank and to deliver the withdrawn fuel to the fuel inlet of the fuel rail.

* * * * *